US010808559B2

(12) United States Patent
Barainca

(10) Patent No.: US 10,808,559 B2
(45) Date of Patent: Oct. 20, 2020

(54) GUIDE VANE RETENTION ASSEMBLY FOR GAS TURBINE ENGINE

(71) Applicant: United Technologies Corporation, Farmington, CT (US)

(72) Inventor: Brian Barainca, Kennebunk, ME (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 345 days.

(21) Appl. No.: 15/995,907

(22) Filed: Jun. 1, 2018

(65) Prior Publication Data

US 2019/0368362 A1 Dec. 5, 2019

(51) Int. Cl.
*F01D 9/04* (2006.01)

(52) U.S. Cl.
CPC ..... *F01D 9/042* (2013.01); *F05D 2220/32* (2013.01); *F05D 2230/60* (2013.01); *F05D 2240/12* (2013.01)

(58) Field of Classification Search
CPC . F01D 9/041; F01D 9/042; F02C 3/04; F05D 2230/50; F05D 2230/60; F05D 2240/12; F05D 2260/30
See application file for complete search history.

(56) References Cited

U.S. PATENT DOCUMENTS 2,812,159 A * 11/1957 Krebs ..... F01D 9/042 415/119
3,266,771 A * 8/1966 Walton ..... F01D 5/30 416/190
4,452,564 A 6/1984 Conant
6,409,472 B1 6/2002 McMahon
6,655,912 B2 12/2003 Bos
9,045,984 B2 * 6/2015 Feigleson ..... F01D 9/042
9,790,802 B2 10/2017 Herraiz
2017/0074110 A1 * 3/2017 Fremont ..... F01D 9/042

FOREIGN PATENT DOCUMENTS

EP 3034799 A1 6/2016
EP 3406854 A1 11/2018
EP 3406855 A1 11/2018
EP 3409904 A1 12/2018
EP 3450687 A1 3/2019

OTHER PUBLICATIONS

EP Search Report dated Oct. 15, 2019 for Application No. 191775881 (6 pages).

* cited by examiner

*Primary Examiner* — Richard A Edgar
*Assistant Examiner* — Maxime M Adjagbe
(74) *Attorney, Agent, or Firm* — Cantor Colburn LLP

(57) ABSTRACT

A guide vane retention system for a gas turbine engine. The system includes an outer diameter shroud defining an aperture. Also included is a guide vane having a radially outer end extending through the aperture, the guide vane defining a slot proximate the radially outer end and positioned radially outwardly of the outer diameter shroud in an installed condition of the guide vane. Further included is a clip disposed within the slot of the guide vane. The clip includes a looped end. The clip also includes a first leg extending away from the looped end to a first free end. The clip further includes a second leg extending away from the looped end to a second free end.

13 Claims, 7 Drawing Sheets

GUIDE VANE RETENTION ASSEMBLY FOR GAS TURBINE ENGINE

BACKGROUND

Exemplary embodiments pertain to the art of gas turbine engines and, more particularly, to a guide vane retention assembly.

In a gas turbine engine used for propulsion, a fan case and a smaller diameter compressor case cooperate to radially bound an annular fan duct. Fan exit guide vanes, or stators, span across the fan duct to de-swirl working medium fluid flowing therethrough. Some engines utilize potting to retain the stators for impact protection. Certain applications have shark-fin shaped vanes that cannot fit through the outer diameter shroud slots during installation, as they could in other vane designs that had uniform chord length over an entire span. A lug that is included on the vane prevents the vanes from being installed by placing the stators between the inner and outer diameter shrouds. Removal of the stator retention lugs allows the vane to be installed between the shrouds, but the lugs are the retention features for impact protection. As such, prior stators suffer from installation and retention drawbacks.

BRIEF DESCRIPTION

Disclosed is a guide vane retention system for a gas turbine engine. The system includes an outer diameter shroud defining an aperture. Also included is a guide vane having a radially outer end extending through the aperture, the guide vane defining a slot proximate the radially outer end and positioned radially outwardly of the outer diameter shroud in an installed condition of the guide vane. Further included is a clip disposed within the slot of the guide vane. The clip includes a looped end. The clip also includes a first leg extending away from the looped end to a first free end. The clip further includes a second leg extending away from the looped end to a second free end.

In addition to one or more of the features described above, or as an alternative, further embodiments may include that the first leg and the second leg extend away from a loop termination location of the looped end.

In addition to one or more of the features described above, or as an alternative, further embodiments may include that the loop termination location is in contact with the guide vane in a fully assembled condition.

In addition to one or more of the features described above, or as an alternative, further embodiments may include that the first leg and the second leg diverge from each other in a direction from the looped end toward the respective free ends.

In addition to one or more of the features described above, or as an alternative, further embodiments may include that the clip is formed from sheet metal.

In addition to one or more of the features described above, or as an alternative, further embodiments may include that the guide vane is a fan exit stator.

In addition to one or more of the features described above, or as an alternative, further embodiments may include a rubber potting applied between the first leg and the second leg after the clip is inserted into the slot.

In addition to one or more of the features described above, or as an alternative, further embodiments may include that the first leg defines a hole.

In addition to one or more of the features described above, or as an alternative, further embodiments may include a rubber potting applied between the first leg and the second leg after the clip is inserted into the slot and within the hole of the first leg to provide a rubber rivet.

In addition to one or more of the features described above, or as an alternative, further embodiments may include that the first leg includes a bent edge region.

Also disclosed is a clip for a guide vane retention system. The clip includes a looped end. The clip also includes a first leg extending away from the looped end to a first free end. The clip further includes a second leg extending away from the looped end to a second free end, the first leg and the second leg diverging from each other in a direction from the looped end toward the free ends, the first leg and the second leg insertable within a slot defined by a guide vane.

In addition to one or more of the features described above, or as an alternative, further embodiments may include that the clip is formed from sheet metal.

In addition to one or more of the features described above, or as an alternative, further embodiments may include a rubber potting applied between the first leg and the second leg after the clip is inserted into the slot.

In addition to one or more of the features described above, or as an alternative, further embodiments may include that the first leg defines a hole.

In addition to one or more of the features described above, or as an alternative, further embodiments may include a rubber potting applied between the first leg and the second leg after the clip is inserted into the slot and within the hole of the first leg to provide a rubber rivet.

In addition to one or more of the features described above, or as an alternative, further embodiments may include that the first leg includes a bent edge region.

Further disclosed is a method of retaining a guide vane of a gas turbine engine. The method includes disposing the guide vane between an inner diameter shroud and an outer diameter shroud. The method also includes rotating the guide vane to position a radially outer end of the guide vane through an aperture of the outer diameter shroud. The method further includes compressing two legs of a clip toward each other. The method yet further includes inserting the two legs of the clip through a slot defined by the guide vane proximate the radially outer end of the guide vane, the slot positioned radially outboard of the outer diameter shroud. The method also includes releasing the two legs of the clip.

In addition to one or more of the features described above, or as an alternative, further embodiments may include operatively coupling a radially inner end of the guide vane to the inner diameter shroud.

In addition to one or more of the features described above, or as an alternative, further embodiments may include applying rubber between the two legs after the clip is inserted within the slot to prevent compression of the two legs.

In addition to one or more of the features described above, or as an alternative, further embodiments may include that the two legs extend from a loop termination location of a looped end of the clip, wherein inserting the two legs of the clip through the slot comprises inserting the two legs until the loop termination location of the clip contacts the guide vane.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
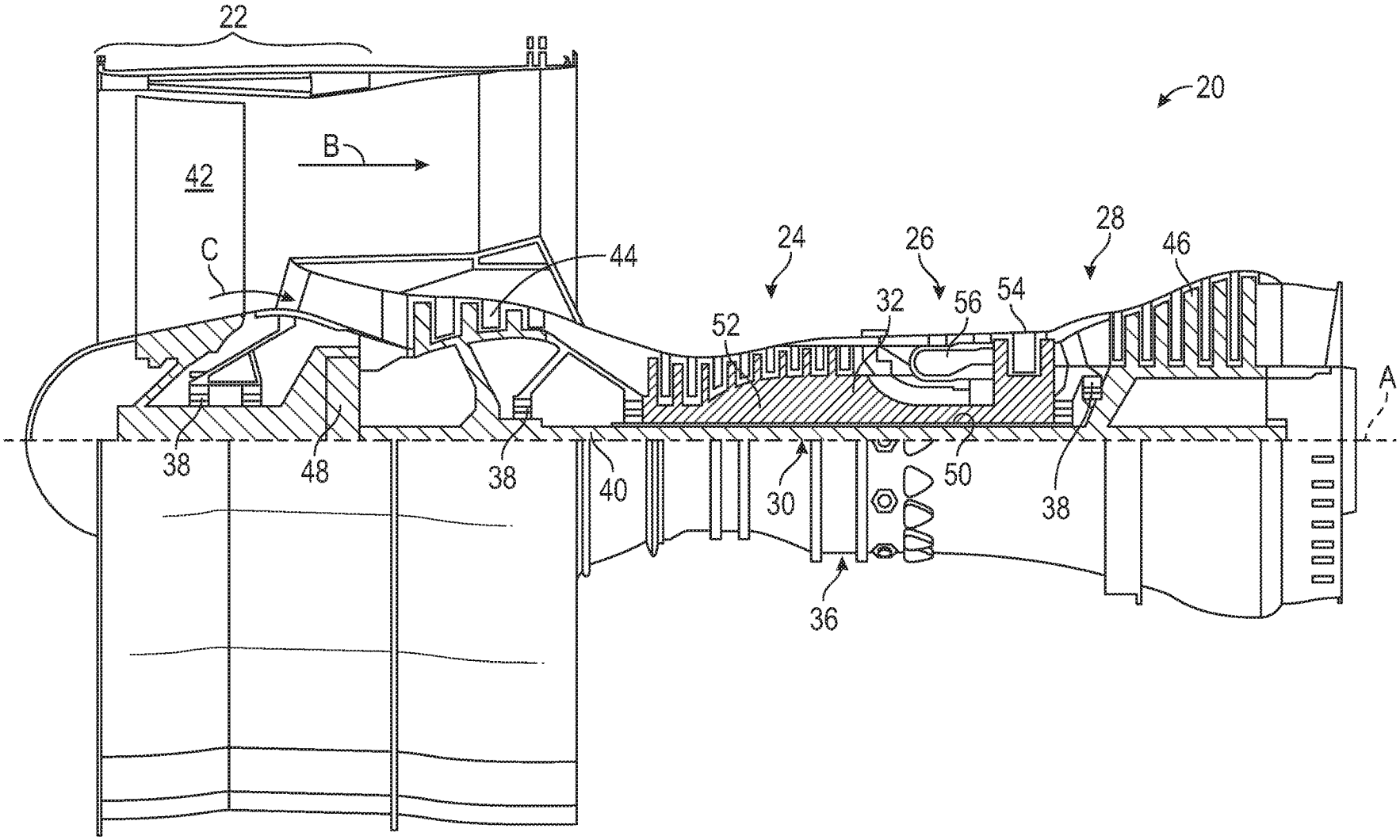
FIG. 1 is a side, partial cross-sectional view of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. An engine static structure 36 is arranged generally between the high pressure turbine 54 and the low pressure turbine 46. The engine static structure 36 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five (5:1). Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present disclosure is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,688 meters). The flight condition of 0.8 Mach and 35,000 feet (10,688 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram °R})/(518.7\text{°R})]^{0.5}$. The "Low corrected fan tip speed" as disclosed herein according to one non-limiting embodiment is less than about 1150 ft/second (350.5 m/sec).

Figure 2:
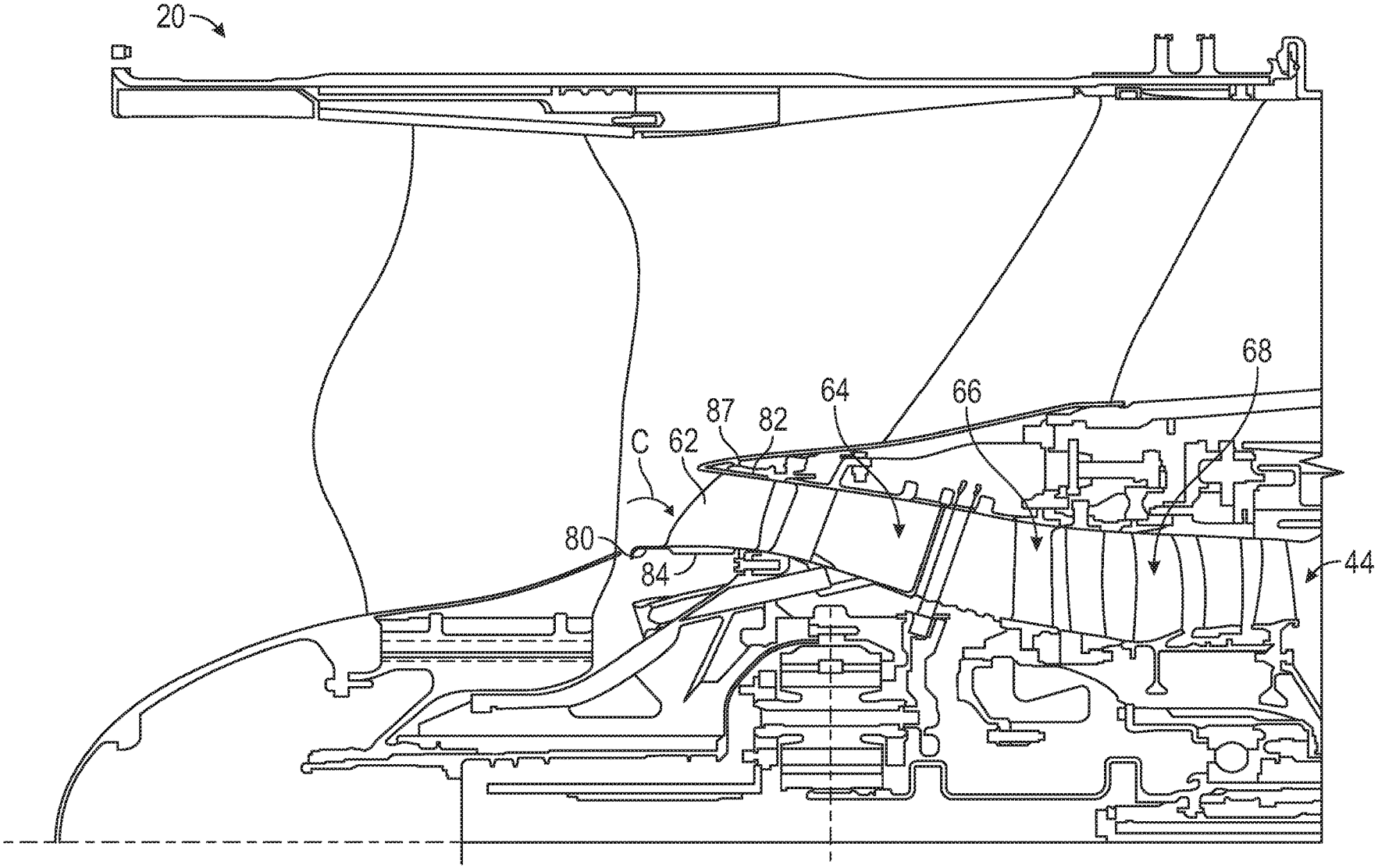
FIG. 2 is a side, partial cross-sectional view of a portion of the gas turbine engine.

Referring to FIG. 2, with continued reference to FIG. 1, the gas turbine engine 20 includes a plurality of fan exit stators 62 (also referred to herein as "guide vanes") positioned around the longitudinal axis A and circumferentially spaced from each other in a substantially axial plane of the gas turbine engine 20. The fan exit stators 62 are located proximate an inlet to the low pressure compressor section 44 of the gas turbine engine.

For purposes of description and clarity, one of the fan exit stators 62 is shown and described herein. The fan exit stator functions as an airfoil to remove a substantial circumferential flow component from air exiting the fan section 22. The core air flow C air passes over the fan exit stator 62. A pressure side of an aft section of the fan exit stator 62 guides the entering air so that upon complete passage of the fan exit stator 62, the air flow is in an axial direction. Air exiting the fan section 22 flows to the low pressure compressor 44. The air entering the low pressure compressor 44 first flows past the fan exit stator 62 and then through a front center body duct 64. The air with reduced swirl then flows through inlet guide vanes 66 and first rotors 68 of the low pressure compressor 44.

Figure 3:
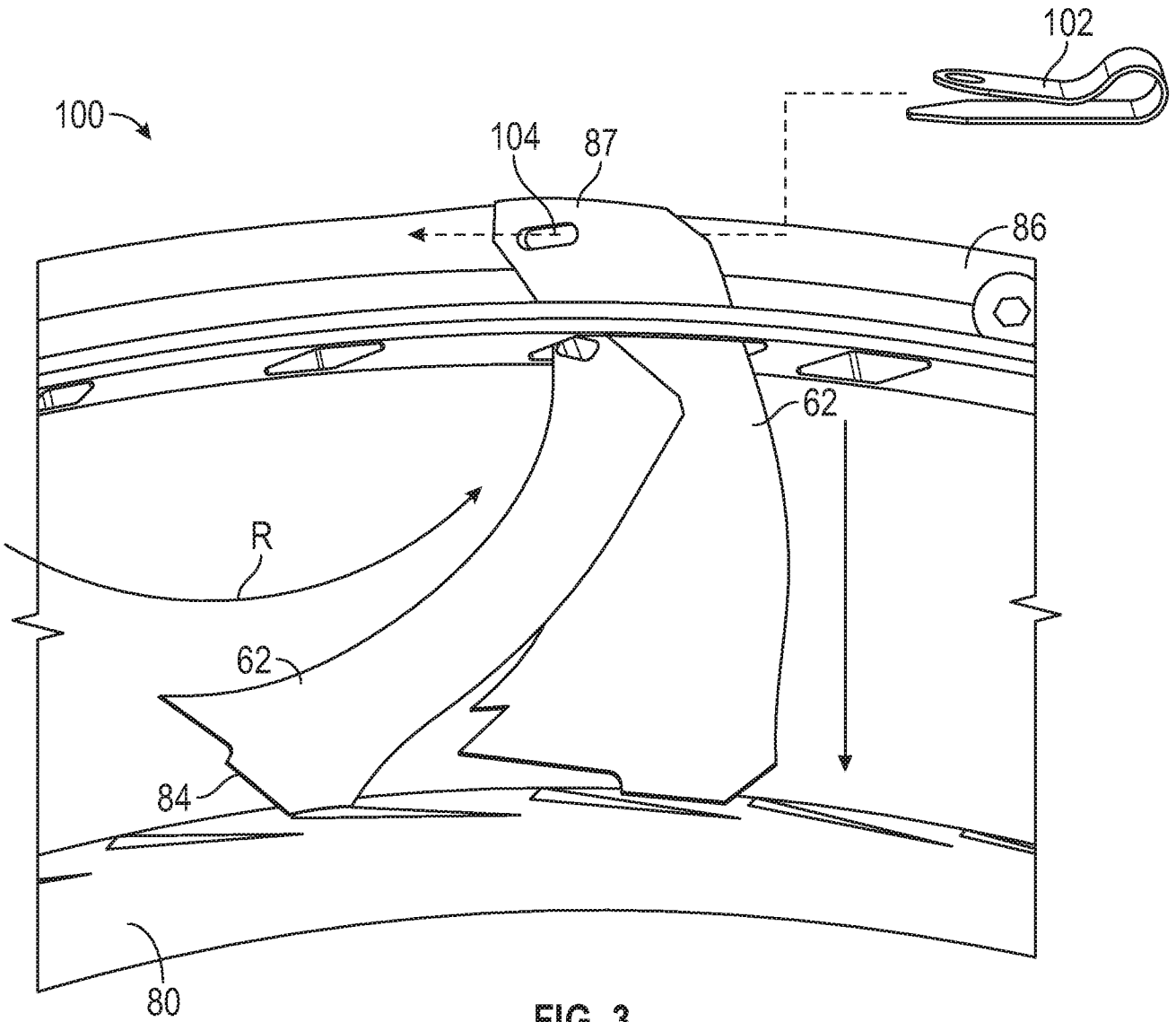
FIG. 3 illustrates a guide vane retention assembly for the gas turbine engine.

Referring now to FIG. 3, a guide vane retention system 100 is illustrated during an assembly process. The guide vane retention system 100 includes the fan exit stator 62, which is radially bound by an inner diameter shroud 80 proximate a radially inner end 84 of the fan exit stator 62 and by an outer diameter shroud 86 proximate a radially outer end 87 of the fan exit stator 62. As shown, the stator 62 is rotated in direction R into an aperture defined by the outer diameter shroud 86. Subsequently, a clip 102 is installed through a slot 104 defined by the stator 62 proximate the radially outer end 87 of the stator 62 at a position of the stator 62 that is radially outboard of the outer diameter shroud 86. The radially inner end 84 of the stator 62 is then seated within, or through, the inner diameter shroud 80. The clip 102 facilitates installing the stator 62 between the shrouds 80, 86 and preserves guide vane retention to the outer diameter shroud 86. This allows single guide vane replacement, thereby avoiding the need for removal of the entire outer diameter shroud 86, or segments thereof.

Figure 4:
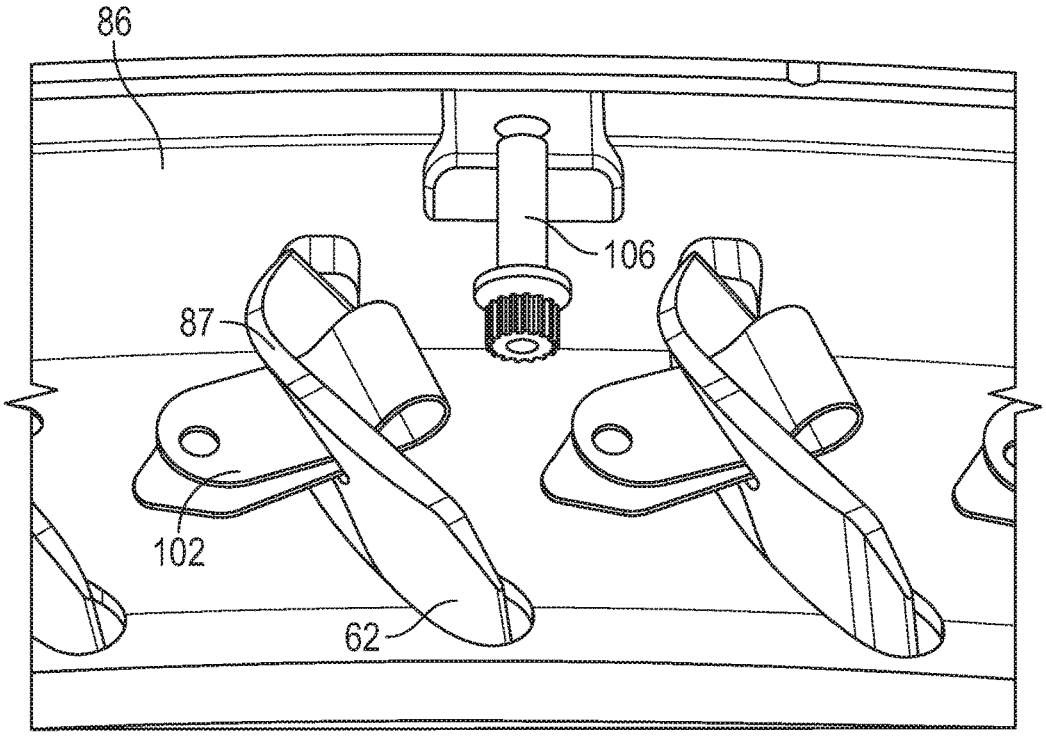
FIG. 4 is a perspective view of the guide vane retention assembly.

FIG. 4 illustrates a portion of the outer diameter shroud 86 with a plurality of stators 62 installed therewith. As shown, the clip 102 prevents withdrawal of the stators 62 from the outer diameter shroud 86 in an installed position of the clip 102. The geometry of the clip 102 and the spacing of the adjacent stators 62 allows for sufficient clearance of one or more mechanical fasteners 106 used to couple the outer diameter shroud 86 to other components.

Figure 5:
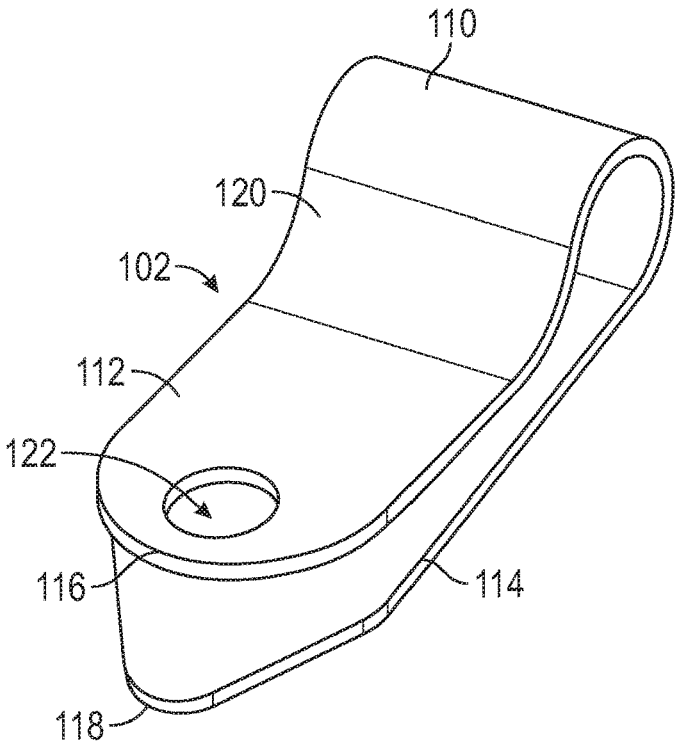
FIG. 5 is a perspective view of a clip of the guide vane retention assembly.

FIG. 5 illustrates the clip 102 in more detail. The clip 102 is a folded strip of sheet metal in some embodiments, but it is contemplated that alternative materials may be utilized. The clip 102 includes a looped end 110 with a radius of curvature that may vary depending upon the specific application. A first leg 112 and a second leg 114 extend away from the looped end 110. The legs 112, 114 diverge from each other in the direction extending away from the looped end 110 and toward respective free ends 116, 118 of the legs 112, 114. In the illustrated embodiment, divergence of the legs 112, 114 begins at a loop termination location 120, thereby forming a shape that may be referred to as a substantially "hourglass" shape.

In the illustrated embodiment, the second leg 114 is longer than the first leg 112, i.e., the free end 118 of the second leg 114 extends further from the looped end 110 than that of the free end 116 of the first leg 112. A longer leg assists with installation into the slot 104 of the stator 62, as the longer leg locates the slot 104. However, it is to be appreciated that equally long legs may be employed in some embodiments. Additionally, the geometry of the free ends 116, 118 may be any suitable geometry, such as rounded ends, pointed ends, etc., or any combination thereof, such as the illustrated geometries.

Figure 9:
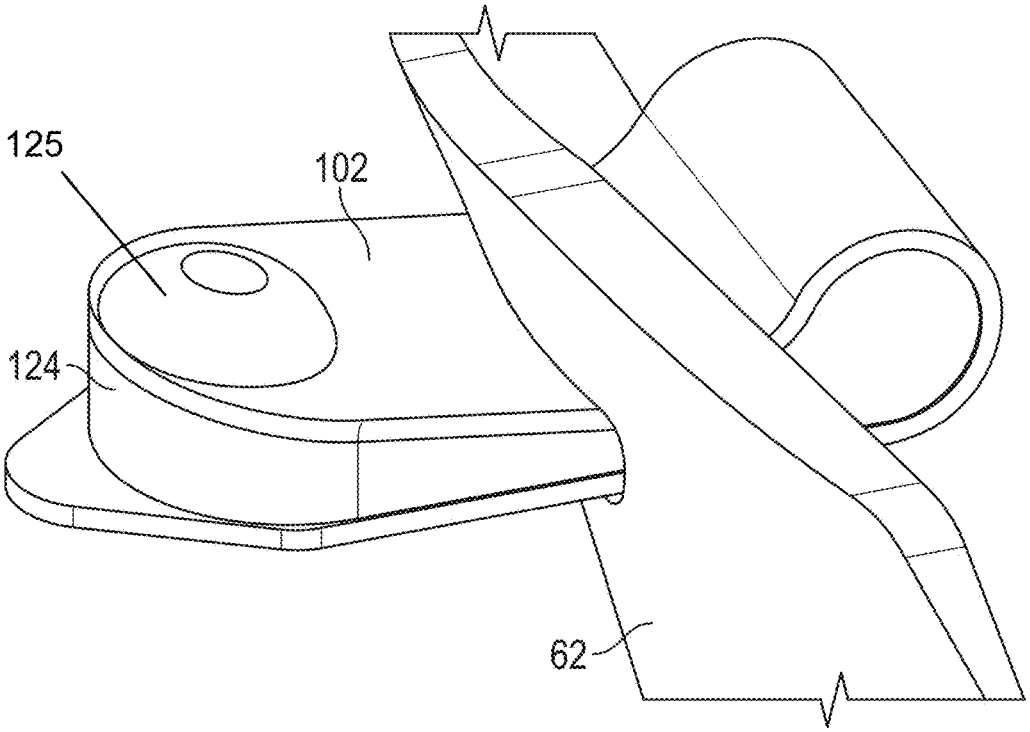
FIG. 9 is a perspective view of the clip potted with rubber.
Figure 10:
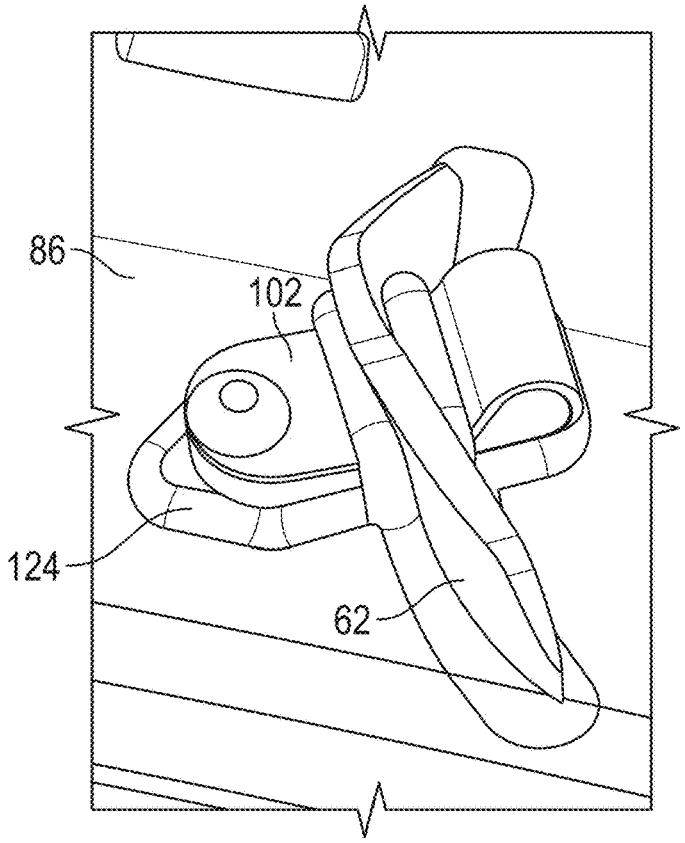
FIG. 10 is a perspective view of the clip potted with rubber according to another aspect of the disclosure.

A hole 122 is defined by the first leg 112 to assist with better retention of an adhesive 124, such as rubber, to the area between the legs 112, 114 of the clip 102 after insertion of the clip legs 112, 114 through the slot 104 of the stator 62. In one embodiment, the rubber potting is applied between the first leg and the second leg after the clip is inserted into the slot and within the hole of the first leg to provide a rubber rivet 125. The adhesive 124, such as rubber, is shown in FIGS. 9 and 10. As shown, the amount and locations of the adhesive 124 may vary, with FIGS. 9 and 10 illustrating non-limiting examples of potting. The potted clip 102 prevents compression of the clip 102, thereby avoiding the possibility of withdrawal of the clip 102, which prevents withdrawal of the stator 62 from the outer diameter shroud 86. Therefore, the clip 102 retains the stator 62 in a reliable manner, while allowing installation of the stator 62 between the shrouds 80, 86.

Figure 6:
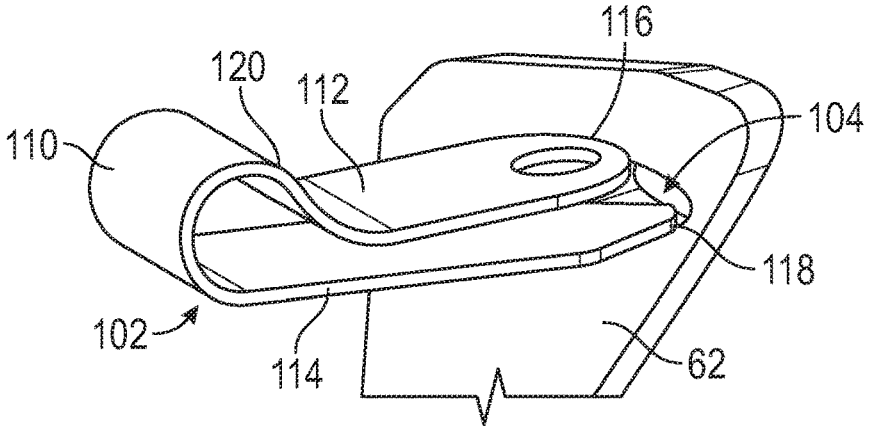
FIG. 6 illustrates a first assembly condition of the clip.
Figure 7:
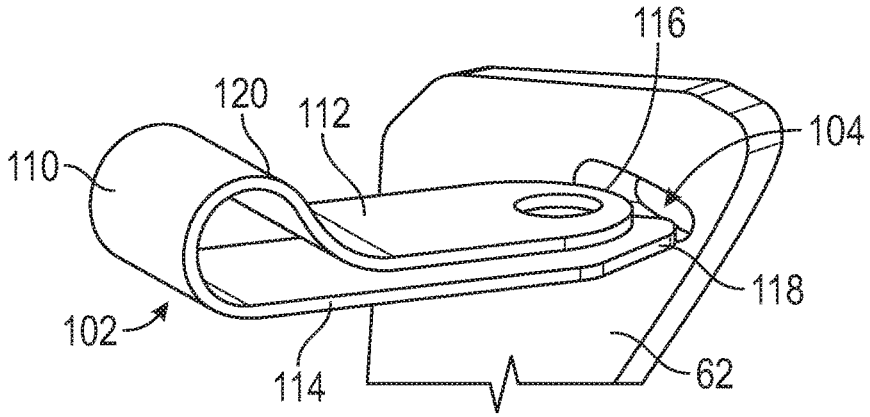
FIG. 7 illustrates a second assembly condition of the clip.
Figure 8:
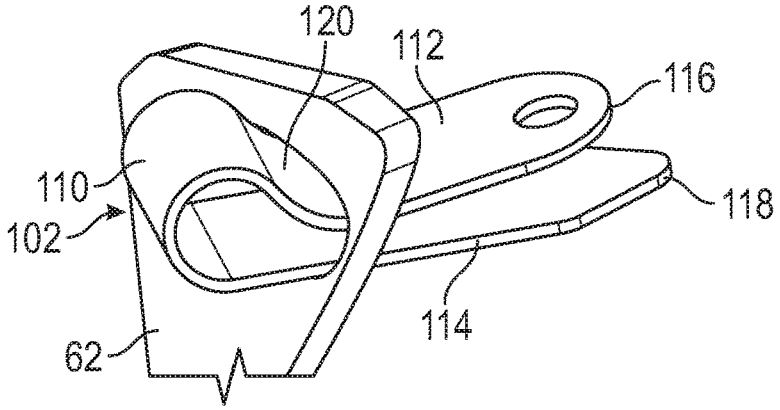
FIG. 8 illustrates a third assembly condition of the clip.

Referring now to FIGS. 6-8, the clip 102 is shown in various stages of the assembly/installation process. The free ends 116, 118 are moved towards the slot 104 of the stator 62 (FIG. 6). As previously described, positioning of the clip 102 relative to the slot 104 in preparation for installation of the clip 102 may be assisted by one of the legs 112, 114 being longer than the other. Once proper positioning of the clip 102 relative to the slot 104 is achieved, the legs 112, 114 are compressed toward each other to an extent necessary for passage of both legs through the slot 104 (FIG. 7). Once the legs 112, 114 are inserted into the slot 104, the clip 102 is translated further until the legs 112, 114 spring apart to prevent resistance to withdrawal of the clip 102 (FIG. 8). In some embodiments, the clip 102 is translated until the loop terminal location 120 engages a surface of the stator 62. The loop terminal location 120 effectively sets the depth of insertion of the clip 102 within the slot 104 of the stator 62, thereby avoiding any uncertainty that may be otherwise present for human installation personnel.

As shown in FIGS. 9 and 10, the clip 102 is filled with the adhesive 124, such as rubber, to pot the stator 62 in the outer diameter shroud 86 after the clip 102 is installed to the desired depth, as described above. The adhesive 124 maintains a spring shape of the clip 102 for clip retention, thereby preventing the clip 102 from compressing enough to back out of the slot 104.

Figure 11:
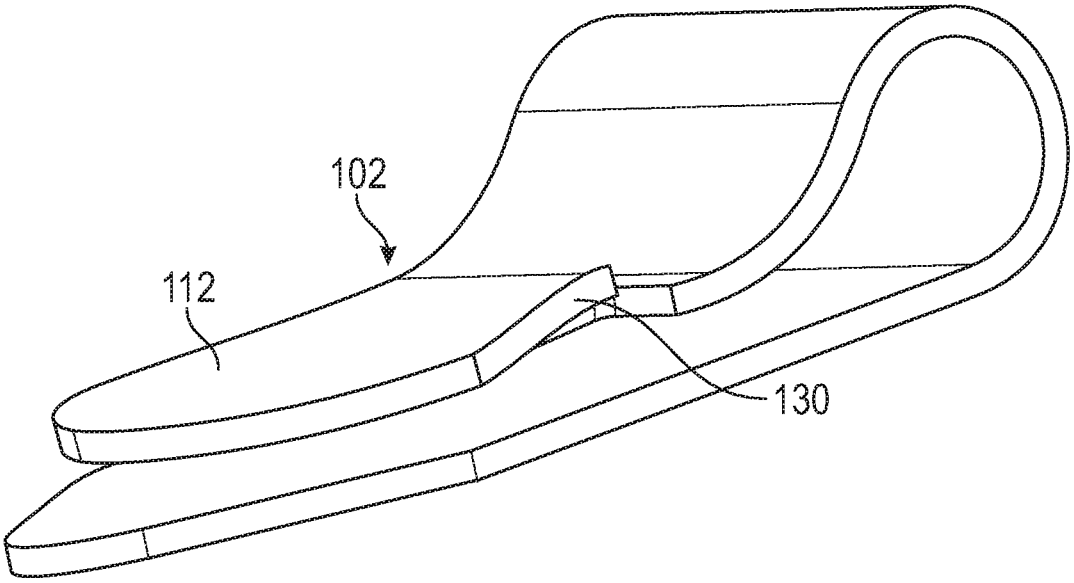
FIG. 11 is a perspective view of the clip according to another aspect of the disclosure.
Figure 12:
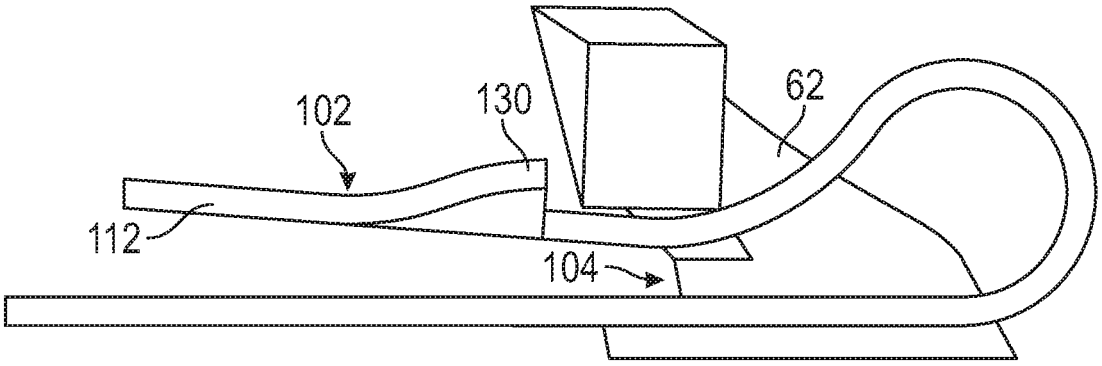
FIG. 12 is a cross-sectional view of the clip of FIG. 11 in an assembled condition.

Referring now to FIGS. 11 and 12, the clip 102 is illustrated according to another aspect of the disclosure. The clip 102 is structurally identical to the above-described clip of FIGS. 3-10. However, the clip 102 of FIGS. 11 and 12 include a bent edge region 130 of the first leg 112. The bent edge region 130 provides additional clip retention to the stator 62. The assembly process is identical to that described in detail above, but the bent edge region 130 must fit through the slot 104 of the stator 62 prior to the springing open action of the clip legs. This embodiment would be potted with rubber or the like as well.

The embodiments disclosed herein employ a simple sheet metal part (or the like), which is easy and inexpensive to manufacture. The clip 102 is easy to install with no yielding required to hold the clip in place. Each stator 62 requires a single clip, thereby allowing a single guide vane to be replaced without the need to disband other guide vanes.

Although the guide vane retention assembly 100 is described herein in connection with a fan exit stator, it is to be appreciated that other fixed guide vanes may benefit from the embodiments described herein.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A guide vane retention system for a gas turbine engine comprising:

an outer diameter shroud defining an aperture;

a guide vane having a radially outer end extending through the aperture, the guide vane defining a slot proximate the radially outer end and positioned radially outwardly of the outer diameter shroud in an installed condition of the guide vane; and a clip disposed within the slot of the guide vane, the clip comprising:

a looped end;

a first leg extending away from the looped end to a first free end, the first leg defining a hole; and a second leg extending away from the looped end to a second free end; and a rubber potting applied between the first leg and the second leg after the clip is inserted into the slot and within the hole of the first leg to provide a rubber rivet.

2. The guide vane retention system of claim 1, wherein the first leg and the second leg extend away from a loop termination location of the looped end.

3. The guide vane retention system of claim 2, wherein the loop termination location is in contact with the guide vane in a fully assembled condition.

4. The guide vane retention system of claim 1, wherein the first leg and the second leg diverge from each other in a direction from the looped end toward the respective free ends.

5. The guide vane retention system of claim 1, wherein the clip is formed from sheet metal.

6. The guide vane retention system of claim 1, wherein the guide vane is a fan exit stator.

7. The guide vane retention system of claim 1, wherein the first leg includes a bent edge region.

8. A clip for a guide vane retention system, the clip comprising:

a looped end;

a first leg extending away from the looped end to a first free end, the first leg defining a hole;

a second leg extending away from the looped end to a second free end, the first leg and the second leg diverging from each other in a direction from the looped end toward the free ends, the first leg and the second leg insertable within a slot defined by a guide vane; and a rubber potting applied between the first leg and the second leg after the clip is inserted into the slot and within the hole of the first leg to provide a rubber rivet.

9. The clip of claim 8, wherein the clip is formed from sheet metal.

10. The clip of claim 8, wherein the first leg includes a bent edge region.

11. A method of retaining a guide vane of a gas turbine engine comprising:

disposing the guide vane between an inner diameter shroud and an outer diameter shroud;

rotating the guide vane to position a radially outer end of the guide vane through an aperture of the outer diameter shroud;

compressing two legs of a clip toward each other;

inserting the two legs of the clip through a slot defined by the guide vane proximate the radially outer end of the guide vane, the slot positioned radially outboard of the outer diameter shroud;

releasing the two legs of the clip; and applying rubber between the two legs and within a hole of the first leg to define a rivet after the clip is inserted within the slot in order to prevent compression of the two legs.

12. The method of claim 11, further comprising operatively coupling a radially inner end of the guide vane to the inner diameter shroud.

13. The method of claim 11, wherein the two legs extend from a loop termination location of a looped end of the clip, wherein inserting the two legs ofthe clip through the slot comprises inserting the two legs until the loop termination location ofthe clip contacts the guide vane.

* * * * *